US006722304B1

(12) United States Patent
Conley

(10) Patent No.: US 6,722,304 B1
(45) Date of Patent: Apr. 20, 2004

(54) BREACH FILLING DEVICE

(76) Inventor: John Edgar Conley, 2038 Palm St. #508, Las Vegas, NV (US) 89104

( * ) Notice: Subject to any disclaimer, the term of this patent is extended or adjusted under 35 U.S.C. 154(b) by 0 days.

(21) Appl. No.: 10/236,170

(22) Filed: Sep. 6, 2002

Related U.S. Application Data

(63) Continuation-in-part of application No. 09/815,701, filed on Mar. 23, 2001, now Pat. No. 6,467,421.

(51) Int. Cl.[7] ..... B63B 43/16
(52) U.S. Cl. ..... 114/227; 138/97; 138/98
(58) Field of Search ..... 114/227, 228, 114/229; 138/97–99; 137/315.1

(56) References Cited

U.S. PATENT DOCUMENTS

| | | | | | |
|---|---|---|---|---|---|
| 5,845 | A | | 10/1848 | Seely | |
| 2,220,085 | A | | 11/1940 | Dirshel | |
| 3,379,218 | A | * | 4/1968 | Conde | 138/99 |
| 3,841,256 | A | | 10/1974 | Etchelecou et al. | |
| 3,958,606 | A | * | 5/1976 | Viramontes | 138/97 |
| 4,012,822 | A | * | 3/1977 | Vrolyk et al. | 29/700 |
| 4,329,132 | A | * | 5/1982 | Melvold et al. | 425/13 |
| 4,390,333 | A | * | 6/1983 | Dubois | 425/11 |
| 5,143,012 | A | | 9/1992 | Elkowitz | |
| 5,245,941 | A | | 9/1993 | Gattuso | |
| 5,253,602 | A | | 10/1993 | Moriarty | |
| 6,058,870 | A | | 5/2000 | Conley | |
| 6,467,421 | B1 | * | 10/2002 | Conley | 114/227 |

FOREIGN PATENT DOCUMENTS

| | | | |
|---|---|---|---|
| DE | 41 34 013 A1 | * | 4/1993 |
| GB | 2 093 146 | * | 8/1982 |

* cited by examiner

*Primary Examiner*—Sherman Basinger

(57) ABSTRACT

A breach filling apparatus for plugging a hole in a wall that includes an air supply assembly, a converting assembly connected to the air supply assembly for converting air pressure to lineal movement, a component storage assembly for storing fluid components of a foaming material therein and expelling the components upon lineal movement by the converting assembly, and a plugging assembly for plugging a hole through a wall structure. The plugging assembly comprises an inflatable flexible bladder having an outer wall defining an interior space for receiving the fluid components and expanding in size from a collapsed condition to an expanded condition. The plugging assembly has a mixing tube in fluid communication with the storage assembly and extends into the interior space of the flexible bladder with a plurality of apertures for expelling the components into the interior space of the flexible bladder.

15 Claims, 9 Drawing Sheets

BREACH FILLING DEVICE

CROSS REFERENCE TO RELATED APPLICATION

This application is a continuation-in-part of application Ser. No. 09/815,701, filed Mar. 23, 2001, which is now U.S. Pat. No. 6,467,421.

BACKGROUND OF THE INVENTION

1. Field of the Invention

The present invention relates to hole plugging devices and more particularly pertains to a new breach filling device for plugging a hole in a structure, such as, for example, a boat.

2. Description of the Prior Art

The use of hole plugging devices is known in the prior art. One such type of device is described in my U.S. Pat. No. 6,058,870. While the device disclosed in that patent can be highly effective for closing and plugging holes, certain improvements have been desired for further simplifying the structure and function of the disclosed device.

The breach filling device according to the present invention substantially departs from the conventional concepts and designs of the prior art, and improves upon my previously patented device, and in so doing provides an apparatus primarily developed for the purpose of plugging a hole in a structure, such as, for example, a boat.

SUMMARY OF THE INVENTION

In view of the foregoing disadvantages inherent in the known types of hole plugging devices now present in the prior art, the present invention provides a new breach filling device construction wherein the same can be utilized for plugging a hole in a structure, such as, for example, a boat.

The general purpose of the present invention, which will be described subsequently in greater detail, is to provide a new breach filling device apparatus and method which has many of the advantages of the hole plugging devices mentioned heretofore and many novel features that result in a new breach filling device which is not anticipated, rendered obvious, suggested, or even implied by any of the prior art hole plugging devices, either alone or in any combination thereof.

To attain this, the present invention generally comprises an air supply assembly, a converting assembly connected to the air supply assembly for converting air pressure to lineal movement, a component storage assembly for storing fluid components of a foaming material therein and expelling the components upon lineal movement by the converting assembly, and a plugging assembly for plugging a hole through a wall structure. The plugging assembly comprises an inflatable flexible bladder having an outer wall defining an interior space for receiving the fluid components and expanding in size from a collapsed condition to an expanded condition. The plugging assembly has a mixing tube in fluid communication with the storage assembly and extends into the interior space of the flexible bladder with a plurality of apertures for expelling the components into the interior space of the flexible bladder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new breach filling device apparatus and method which has many of the advantages of the hole plugging devices mentioned heretofore and many novel features that result in a new breach filling device which is not anticipated, rendered obvious, suggested, or even implied by any of the prior art hole plugging devices, either alone or in any combination thereof.

It is another object of the present invention to provide a new breach filling device which may be easily and efficiently manufactured and marketed.

It is a further object of the present invention to provide a new breach filling device which is of a durable and reliable construction.

An even further object of the present invention is to provide a new breach filling device which is susceptible of a low cost of manufacture with regard to both materials and labor, and which accordingly is then susceptible of low prices of sale to the consuming public, thereby making such breach filling device economically available to the buying public.

Still yet another object of the present invention is to provide a new breach filling device which provides in the apparatuses and methods of the prior art some of the advantages thereof, while simultaneously overcoming some of the disadvantages normally associated therewith.

Still another object of the present invention is to provide a new breach filling device for plugging a hole in a structure, such as, for example, a boat.

Yet another object of the present invention is to provide a new breach filling device which includes an air supply assembly, a converting assembly connected to the air supply assembly for converting air pressure to lineal movement, a component storage assembly for storing fluid components of a foaming material therein and expelling the components upon lineal movement by the converting assembly, and a plugging assembly for plugging a hole through a wall structure. The plugging assembly comprises an inflatable flexible bladder having an outer wall defining an interior space for receiving the fluid components and expanding in size from a collapsed condition to an expanded condition. The plugging assembly has a mixing tube in fluid communication with the storage assembly and extends into the interior space of the flexible bladder with a plurality of apertures for expelling the components into the interior space of the flexible bladder.

Still yet another object of the present invention is to provide a new breach filling device that may be used to plug a breach in the hull of a boat from both inside and outside the boat.

Even still another object of the present invention is to provide a new breach filling device that is portable so that it may be quickly and easily transported to the breach location.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
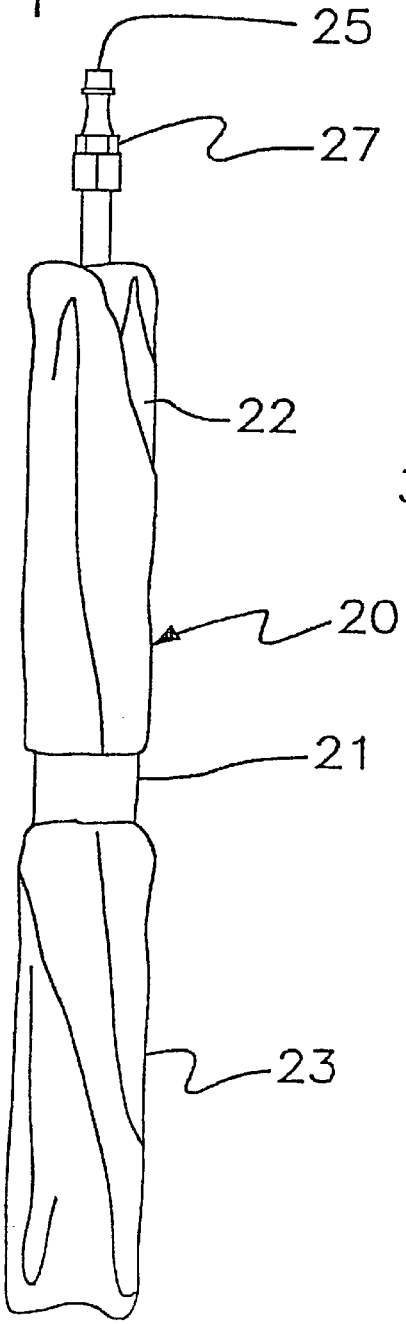
FIG. 1 is a schematic side view of a deflated bladder inflatable of a new breach filling device according to the present invention.

With reference now to the drawings, and in particular to FIGS. 1 through 11 thereof, a new breach filling device embodying the principles and concepts of the present invention and generally designated by the reference numeral 10 will be described.

In use, the breach filling device 10 is designed for providing a water-tight plug of a hole 2 in a structure 1 such as a breach in a hull or bulkhead of a boat. The breach filling device may be used from the interior side of the breach or from the water side of the breach to close the breach. As best illustrated in FIGS. 1 through 8, the breach filling device 10 generally comprises a container 11 having a plurality of reservoirs for holding a foaming material therein and a flexible inflatable bladder 20 having an interior space. The interior space of the inflatable bladder 20 is in fluid communication with the reservoir of the container 11 to permit passage of foaming material from the reservoirs of the container 11 into an interior space of the inflatable bladder 20. The foaming material forms a foamed material in the interior space of the inflatable bladder 20 such that the foamed material inflates the inflatable bladder 20.

Figure 2:
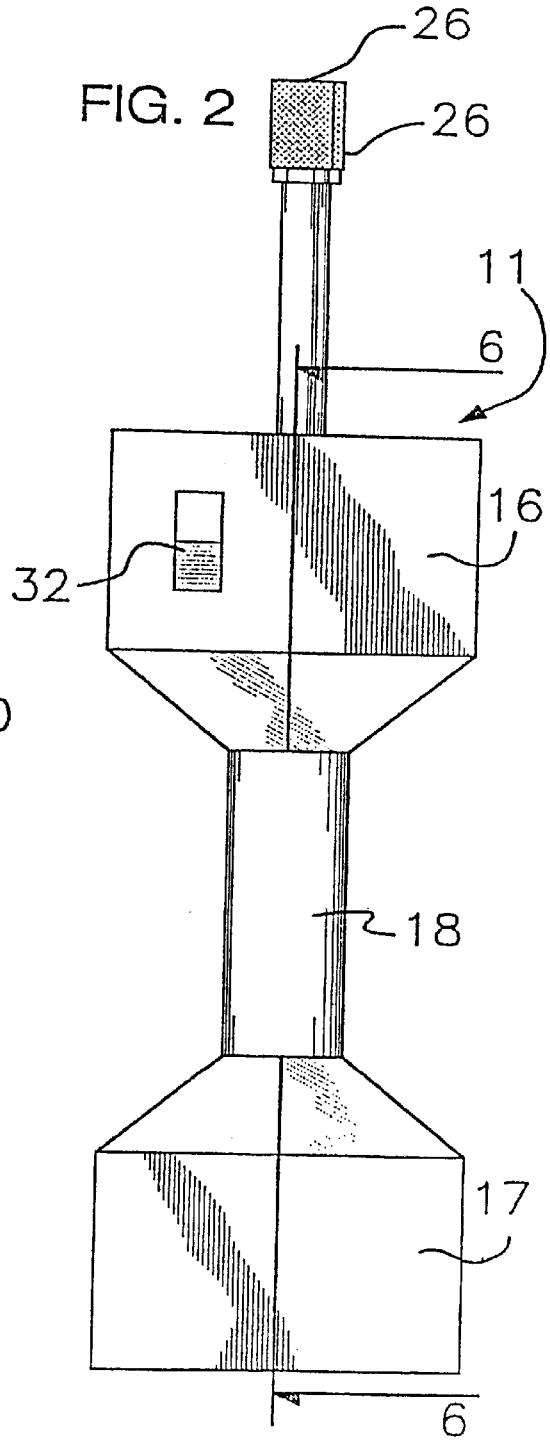
FIG. 2 is a schematic side view of the container of the present invention.

In closer detail, the portable container 11 has a plurality of reservoirs therein for holding a foaming fluidic material therein. Ideally, the foaming material comprises a two component foaming polymer fluidic material 12, 13, such as a urethane and a reagent. Preferably, the reservoirs of the container 11 comprise separate first and second component reservoirs 14, 15 for keeping the components 12, 13 of the foaming material separate in the container 11. In particular, the first component reservoir 14 is designed for holding one of the components 12 of the foaming material and the second component reservoir 15 is designed for holding the other component 13 of the foaming material. In the ideal embodiment, as illustrated in FIG. 2, the container 11 is generally dumbbell-shaped and has a pair of spaced apart end portions 16, 17 and a generally cylindrical handle 18 portion connecting the end portions 16, 17 of the container 11 together. The handle 18 is designed for permitting easy grasping of the container 11 by a user, while enhancing the size of the reservoirs in the container.

Figure 3:
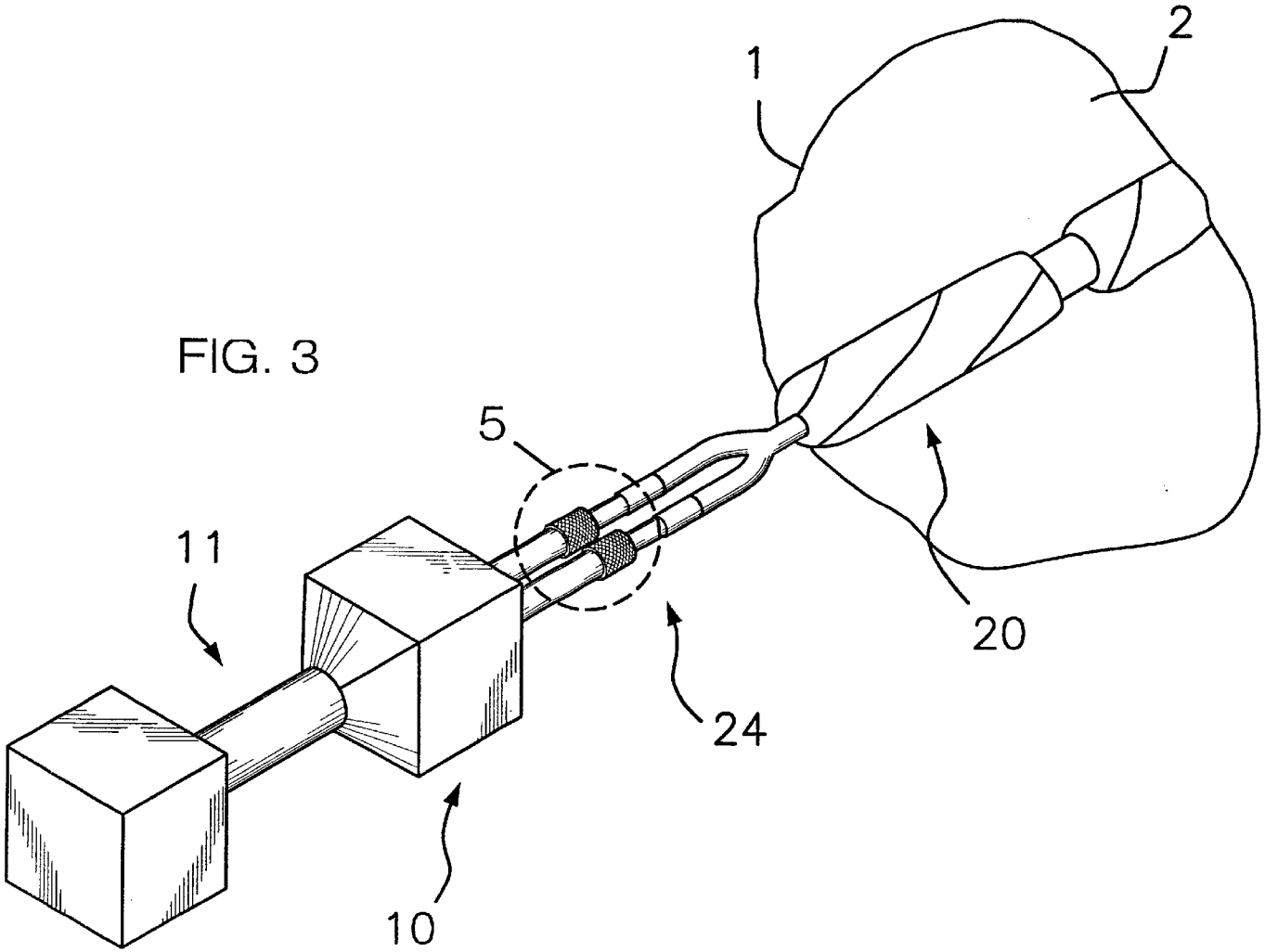
FIG. 3 is a schematic perspective view of the present invention with the deflated inflatable bladder in use being inserted into a hole in a structure.
Figure 4:
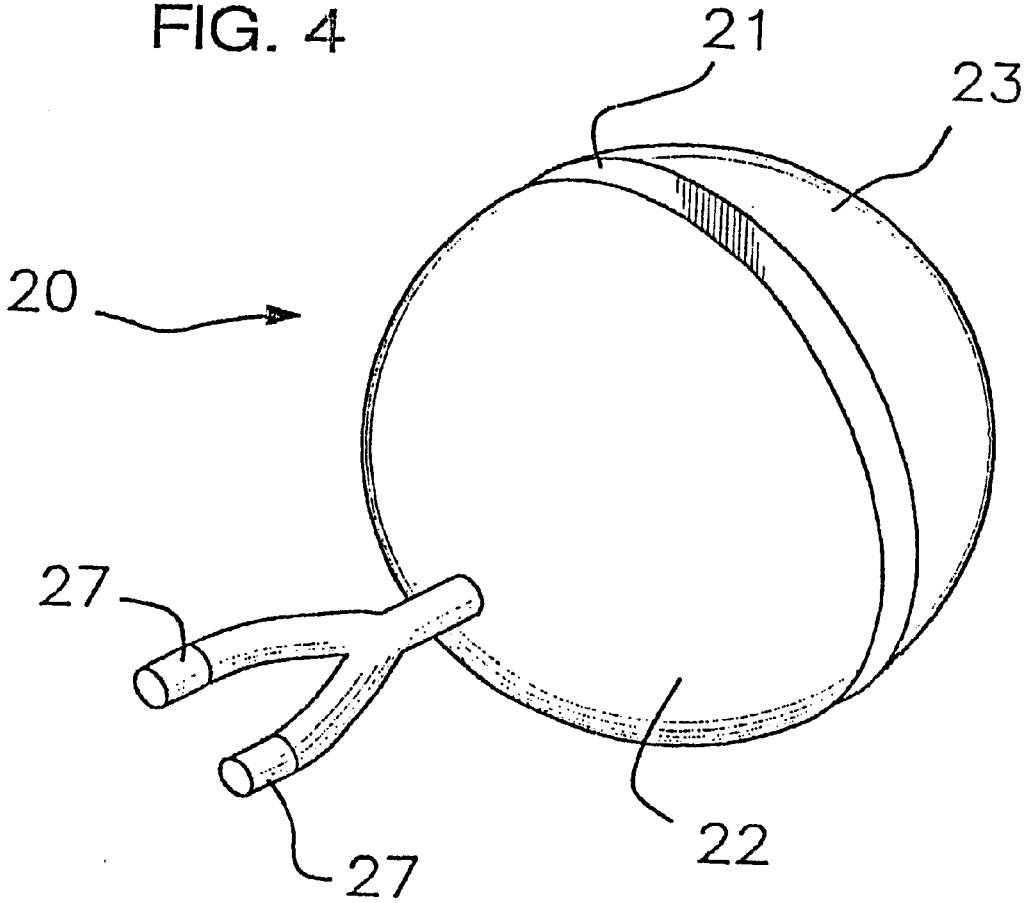
FIG. 4 is a schematic perspective view of an inflated inflatable bladder of the present invention.
Figure 8:
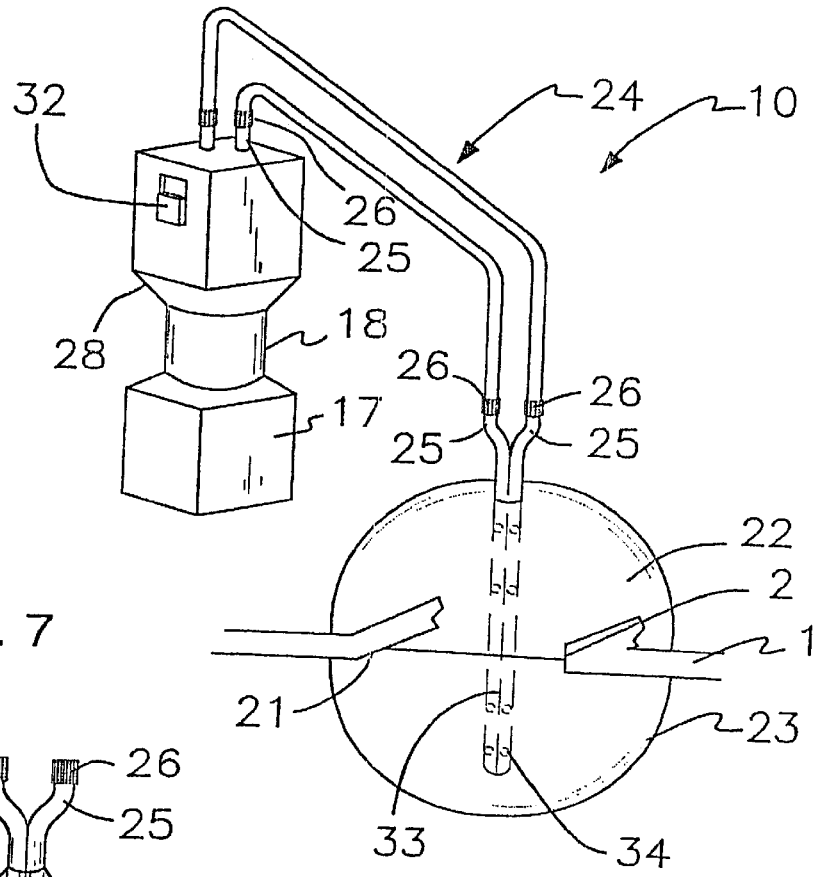
FIG. 8 is a schematic view of the present invention in use plugging a hole in a structure.

The breach filling device 10 also includes a flexible inflatable bladder 20 having an interior space. With reference to FIGS. 3 and 8, the inflatable bladder 20 is designed for inserting into a hole 2 in a structure 1 so that expansion or inflation or distention of the inflatable bladder 20 closes the hole 2 in the structure 1. Preferably, inflation of the inflatable bladder 20 provides a substantially water tight closure of the hole 2 in the structure 1. As illustrated in FIG. 4, the inflatable bladder 20 may be generally spherical when inflated. Ideally, the inflatable bladder 20 comprises a rip resistant flexible material so that it can conform to unevenly shaped holes in a structure and will not be easily punctured by any sharp edges around the hole in the structure. The inflatable bladder 20 has an annular constriction 21, or seam, around the circumference of the inflatable bladder 20. The annular constriction 21 divides the inflatable bladder 20 into a pair of preferably generally hemispherical portions 22, 23. The annular constriction 21 defines an annular channel between the portions 22, 23 of the inflatable bladder 20. As illustrated in FIG. 8, the annular channel of the inflatable bladder 20 is designed for receiving the portion of the structure 1 around the periphery of the hole 2 in the structure 1 when the inflatable bladder 20 is inserted into the hole 2 in the structure 1 and inflated such that the structure 1 is sandwiched between the circumferences of the hemispherical portions 22, 23 of the inflatable bladder 20.

Figure 5:
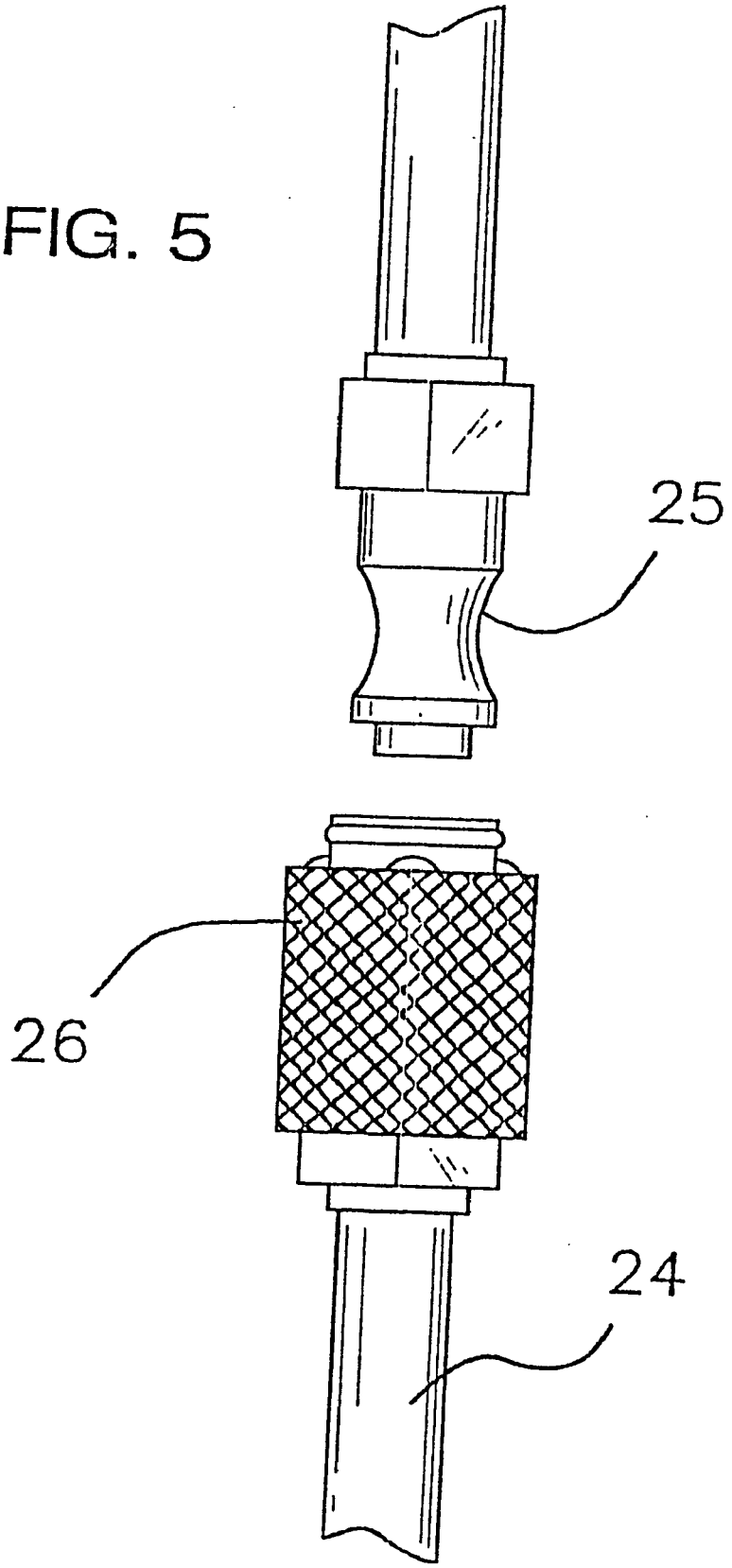
FIG. 5 is a schematic side view of a detachable coupling of the conduit system of the present invention taken from the circle 5 on FIG. 3.
Figure 6:
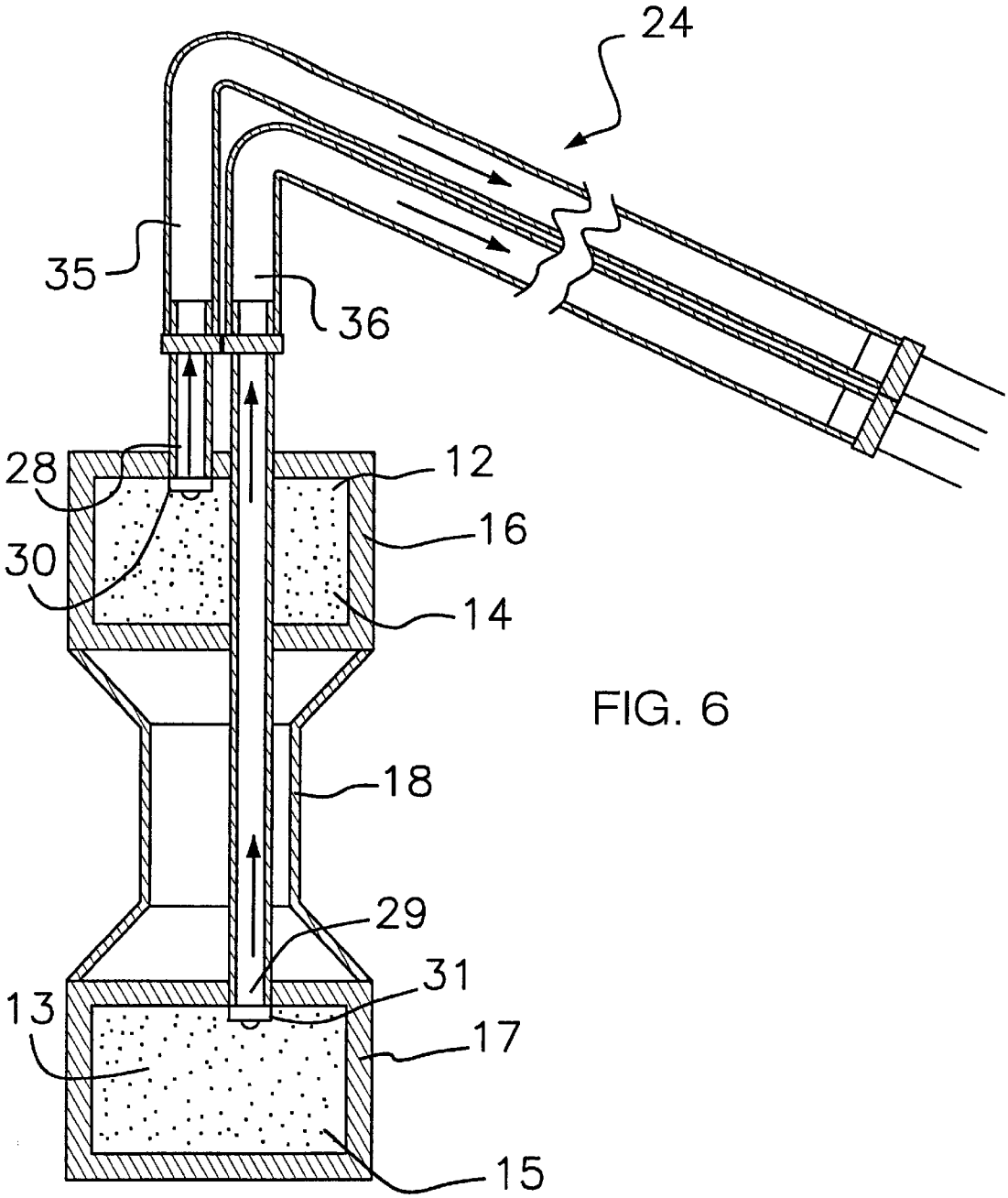
FIG. 6 is a schematic cross-sectional view of the container of the present invention taken from line 6—6 of FIG. 2.

The interior space of the inflatable bladder 20 is selectively in fluid communication with the reservoirs of the container 11. Preferably, an elongate conduit system 24 fluidly connects the interior space of the inflatable bladder 20 to the reservoirs of the container 11 to permit passage of foaming material from the reservoirs of the container 11 into interior space of the inflatable bladder 20. In use, the foaming material forms a foamed material (such as solidifying polyurethane of the type used for foamed insulation) in the interior space of the inflatable bladder 20 such that the foamed material inflates the inflatable bladder 20 to close the hole 2 in the structure 1. Ideally, the conduit system 24 comprises a pair of flexible tubes 35, 36 or hoses and has a pair of opposite ends. One end of the conduit system 24 is fluidly connected to the reservoirs of the container 11 and the other end of the conduit system 24 is fluidly connected to the interior space of the inflatable bladder. The one end of the tubes of the conduit system 24 is preferably detachably attached to the container 11 while the other end of the tubes of the conduit system 24 are also preferably detachably attached to the inflatable bladder 20. With reference to FIG. 5, ideally, the detachable attachments of the ends of the conduit system 24 comprise a quick release plug 25 and socket 26 fluid connector. In the ideal embodiment, the inflatable bladder 20 also has a pair of valves 27 for closing the opening into the inflatable bladder 20 when the other end of the conduit system 24 is detached from the inflatable bladder 20.

In the preferred embodiment, the first tube 35 of the conduit system 24 has a first intake 28 opening into the first component reservoir 14 of the container 11 and the second tube 36 of the conduit system 24 has a second intake 29 opening into the second component reservoir 15 of the container 11. The conduit system 24 also preferably has first and second valves 30, 31. The first valve selectively closes the first intake 28 of one of the tubes of the conduit system 24 while the second valve 31 selectively closes the second intake 29 of another of the tubes of the conduit system 24. A release switch 32 is operationally connected to the first and second valves 30, 31. The release switch 32 permits opening of the first and second valves 30, 31 to permit the components of foaming material into the first and second intakes 28, 29 of the conduit system 24. Preferably, the switch 32 is mounted on the exterior of the container 11 so that a user grasping the container can easily open valves. The switch may be comprised of an electrical solenoid or mechanical linkage that actuates the valves to allow the pressurized contents of the first and second component reservoirs to exit into the conduit system.

Figure 7:
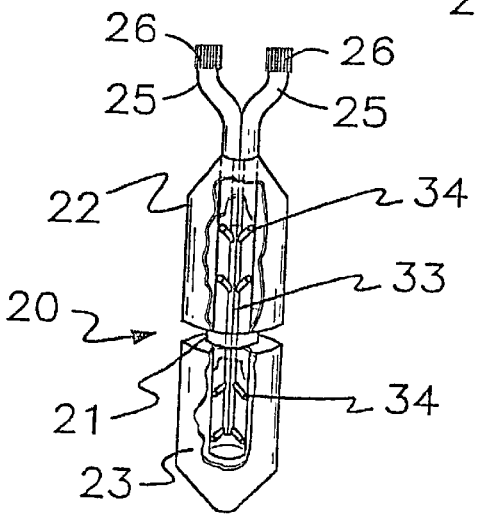
FIG. 7 is a schematic side view of the inflatable bladder of the present invention with a portion broken away to reveal interior detail of the bladder.

With reference to FIG. 7, the conduit system 24 has an elongate nozzle 33 in the interior space of the inflatable bladder 20. The nozzle 33 has an interior wall for preventing mixture of the two components of foaming material until both the components reach the interior of the bladder 20. The nozzle 33 has a plurality of apertures 34 providing openings into the conduit system 24. The apertures 34 of the nozzle 33 permit passage of foaming material from the conduit system 24 into the interior space of the inflatable bladder 20. As illustrated in FIG. 1, the inflatable bladder 20 is ideally folded around the nozzle 33 when the inflatable bladder 20 is deflated to help make it easier to insert the deflated inflatable bladder 20 in a hole 2 in a structure 1 as illustrated in FIG. 3.

In use, the foaming material passes into the conduit system 24 through the intakes 28, 29 of the tubes 35, 36 of the conduit system 24 and exits from the apertures 34 of the nozzle 33 of the conduit system 24 into the interior space of the inflatable bladder 20 to form a foam material which inflates the inflatable bladder 20. As illustrated in FIG. 8, the inflatable bladder 20 closes the hole 2 in the structure 1 from the both sides of the structure 1. Once the inflatable bladder 20 is inflated, water pressure on the portion 23 of the inflatable bladder 20 on the side of the structure 1 exposed to the water (such as the exterior side of a hull of a boat) presses the portion 23 of the inflatable bladder 20 against the structure 1 to help further keep the closure of the hole 2 in the structure 1 water tight.

Figure 9:
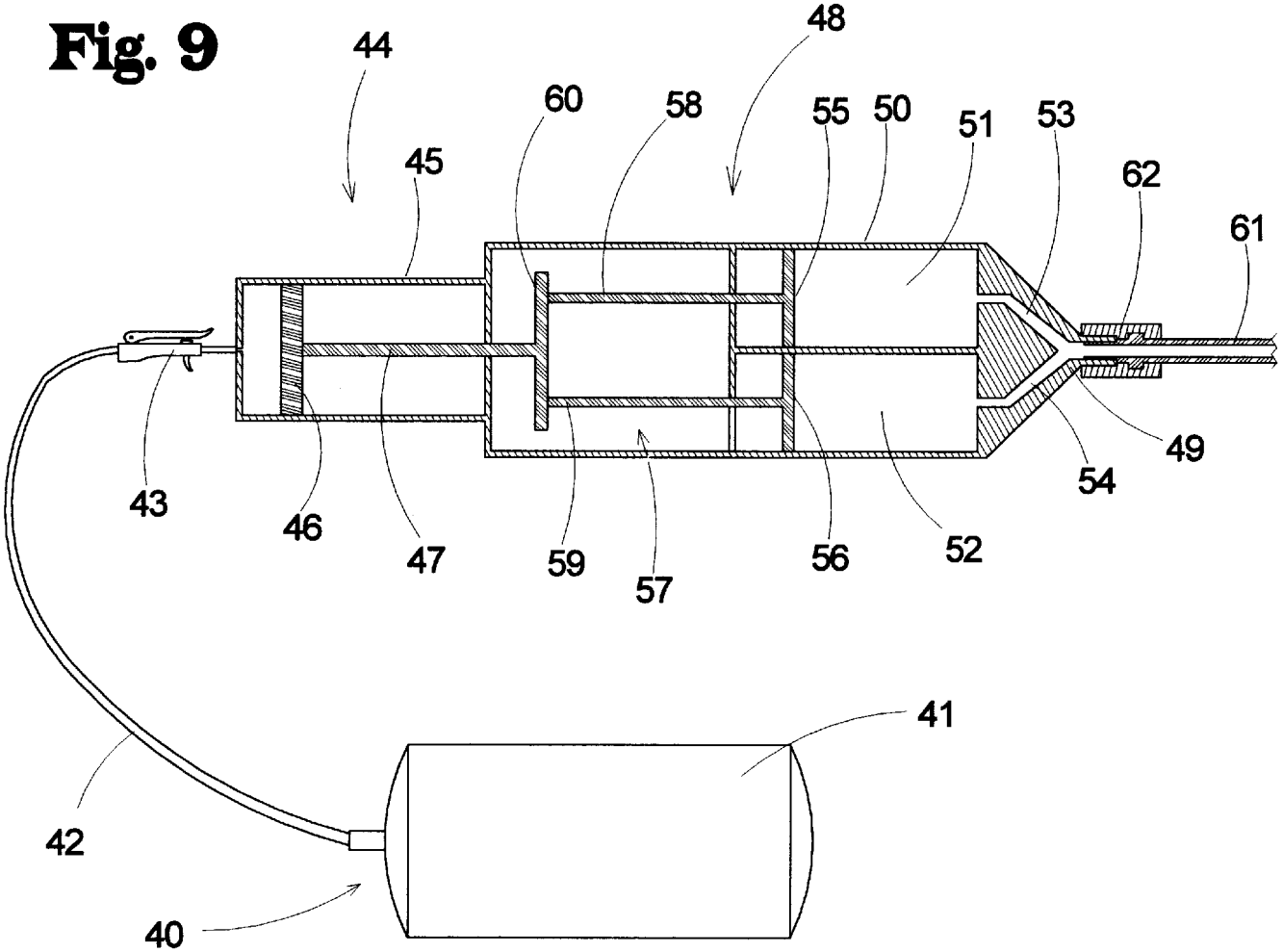
FIG. 9 is a schematic sectional view of an embodiment of the invention having optional air supply assembly, converting assembly, and component storage assembly features of the present invention.
Figure 10:
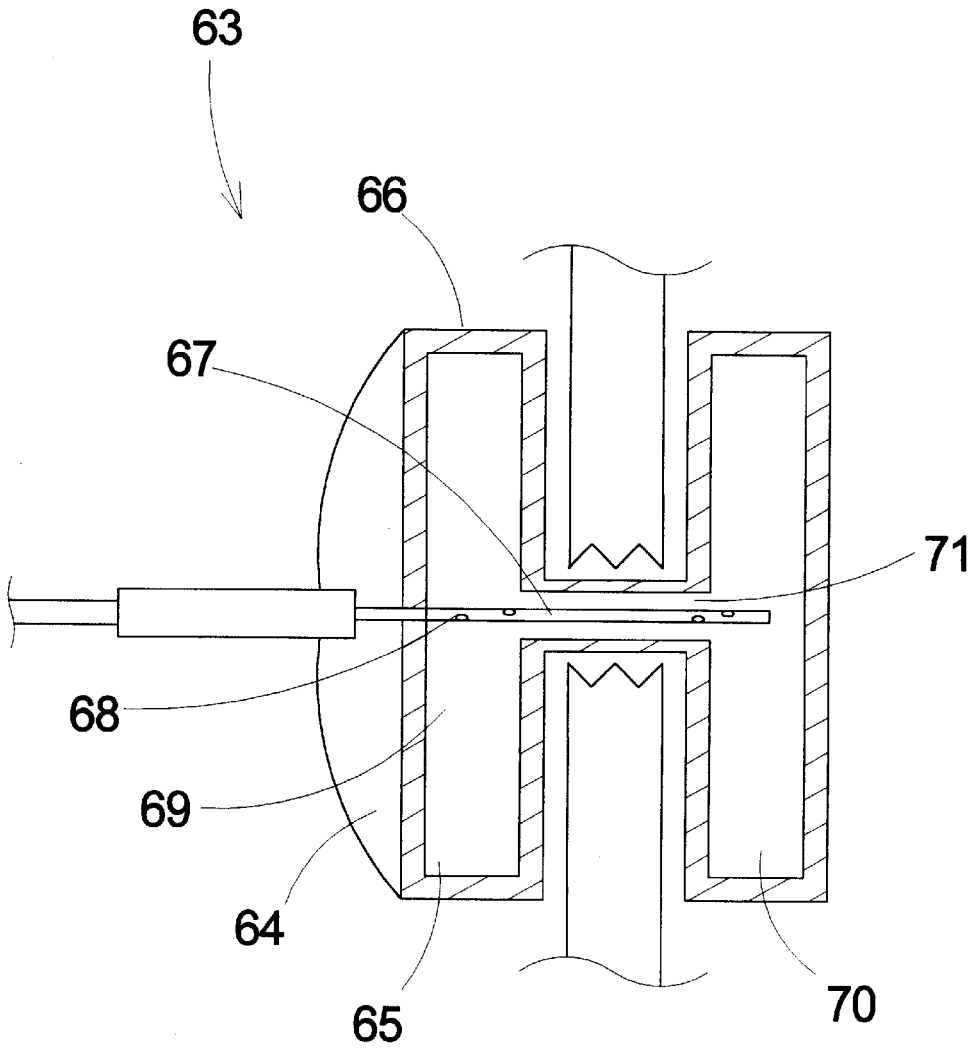
FIG. 10 is a schematic sectional view of an optional flexible bladder configuration of the present invention.
Figure 11:
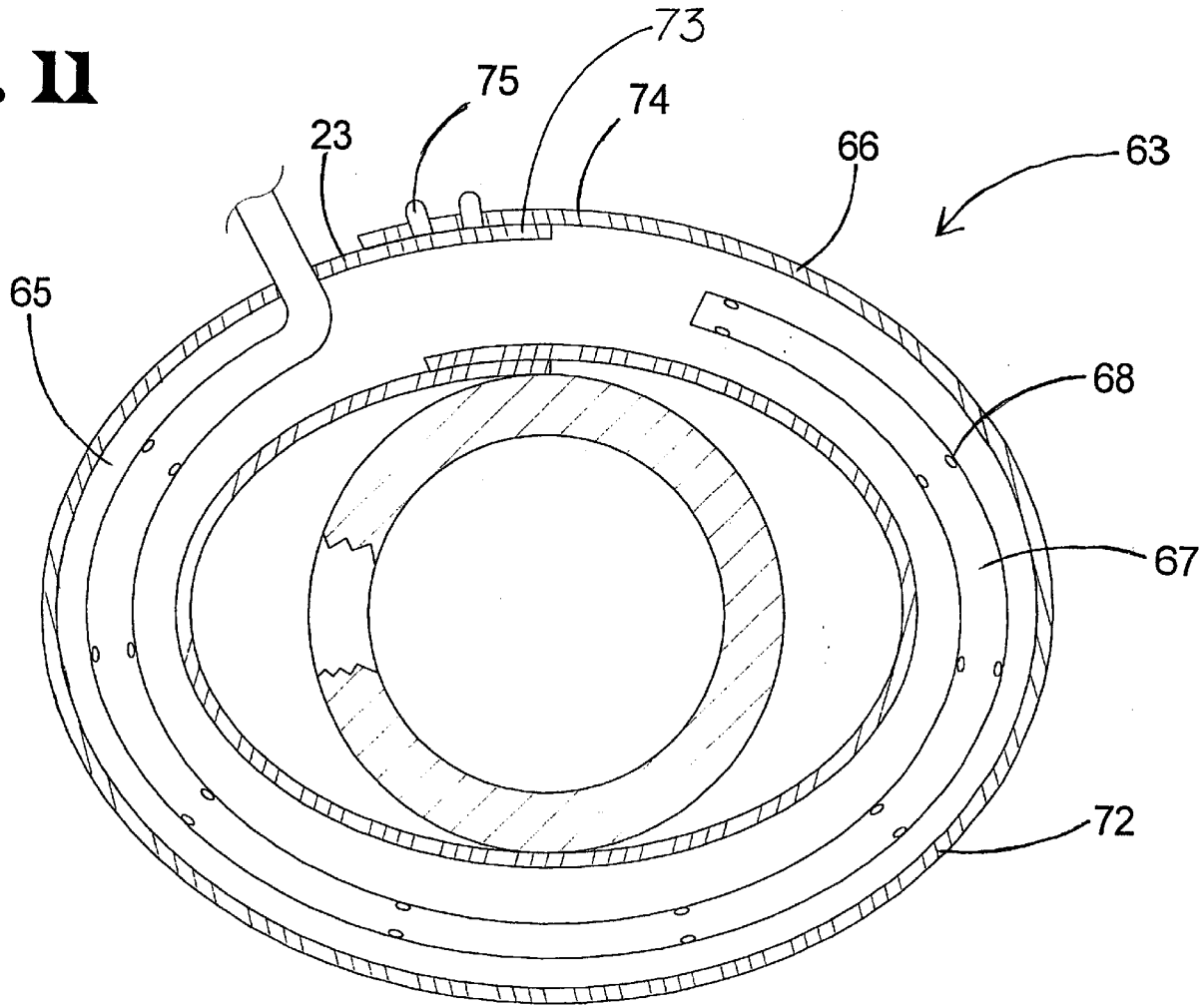
FIG. 11 is a schematic sectional view of an optional flexible bladder configuration of the present invention.

Various optional features may be incorporated in the various embodiments of the present invention, and some of these optional features are shown in FIGS. 9 through 11 of the drawings. In FIG. 9, a portion of an optional air pressure-powered embodiment is shown that utilizes air (or other suitable gaseous material) pressure to force the components out of the storage means into the breach. Such an embodiment may include an air supply assembly 40 for supplying pressurized air and that includes a tank 41 for holding pressurized air and having an outlet, an air conduit 42 in fluid communication with the outlet of the tank 41, and a valve 43 in fluid communication with the air conduit for controlling air flow through the air conduit. The valve 43 may be mounted on the air conduit 42.

A converting assembly 44 may be provided for converting the air pressure from the air in the air supply assembly to lineal movement that may be utilized for forcing the components in the desired location at the breach, and may be connected to the air supply assembly 40 for supplying the pressurized air. The converting assembly 44 may include a housing 45 having an interior that is in communication with the outlet of the air tank 41. Optionally, the interior of the housing 45 may be substantially cylindrical. The converting assembly 44 may also include a piston 46 that is movably mounted in the interior of the housing 45 on a shaft 47 such that pressurized air moving into the interior of the housing pushes the piston and the shaft from a first position toward a second position in the interior. The shaft 47 extends out of the interior of the housing, and moves farther out of the interior as the piston moves from the first toward the second position.

A component storage assembly 48 may be provided for storing the fluid components of a foaming material therein and expelling the components upon lineal movement by the converting assembly 44. The component storage assembly 48 may have an outlet 49 through which the components stored in the component storage assembly exit the storage assembly. The component storage assembly 48 may include a storage housing 50 that defines a first chamber 51 for holding a first component and a second chamber 52 for holding a second component. Each of the chambers 51, 52 may have a chamber outlet, with the chamber outlet of the first chamber being in communication with a first conduit 53 and the chamber outlet of the second chamber being in communication with a second conduit 54. The component storage assembly 48 may include a first piston 55 that is slidably mounted in the first chamber 51 and a second piston 56 mounted in the second chamber 52.

The component storage assembly 48 may also include a plunger assembly 57 that is operatively connected to the shaft 47 and the piston 46 of the converting assembly 44 and to the first 55 and second 56 pistons for moving the pistons 55, 56 in the chambers 51, 52 when the converting assembly converts air pressure to lineal movement. The plunger assembly 57 may also comprise a first rod 58 mounted on the first piston 55 that extends out of the first chamber 51, and a second rod 59 mounted on the second piston 56 that extends out of the second chamber 52. The plunger assembly may also include a connecting member 60 that connects the first 58 and second 59 rods together for moving the first and second rods and the first 55 and second 56 pistons together in unified movement. The connecting member 60 may be connected to the shaft 47 of the converting assembly 44 such that the movement of the piston 46 of the converting assembly is transferred to the pistons 55, 56 of the component storage assembly. While the air supply assembly 40 may comprise a separate unit, the air supply assembly may be integrated into or otherwise mounted on the converting assembly 44 and optionally the component storage assembly 48.

An outlet conduit 61 may be provided that is in fluid communication with the outlet 49 of the component storage assembly 48 for receiving the components outputted from and exiting the component storage assembly. The outlet conduit 61 may have a quick release connector 62 mounted thereon for releasably connecting to the outlet 49 of the component storage assembly. The outlet conduit may have a pair of lumens formed therein for carrying the first and second components separately to through a length of the outlet conduit such that the components do not mix in the outlet conduit.

A plugging assembly 63 may be provided for plugging a hole or rupture or breach that extends through virtually any suitable type of wall structure. The plugging assembly 63 may generally include an inflatable flexible bladder 64 that has an interior space 65 for receiving the fluid components to cause expansion or distention of the bladder 64 from a collapsed condition to an expanded condition. The flexible bladder has an outer wall 66 that defines the interior space 65. The plugging assembly 63 may also include a mixing tube 67 in fluid communication with the outlet conduit 61 and extending into the interior space 65 of the flexible bladder 64 for expelling the components into the interior space of the flexible bladder. The mixing tube 67 may have a plurality of apertures 68 therein for dispensing the components from the mixing tube into the interior space 65 of the flexible bladder.

In one optional embodiment (see FIG. 10), the flexible bladder 64 includes a first portion 69, a second portion 70, and a linking portion 71 that extends between and links the first and second portions. The first 69 and second 70 portions may generally have a disc shape with substantially planar inner and outer faces when the flexible bladder is in the expanded condition. The linking portion 71 may extend between the inner faces of the first 69 and second 70 portions. The mixing tube 67 may extend through the interior space of the first portion 69 and the linking portion 71 and into the interior space of the second portion 70. Each of the first and second portions may have a substantially circular perimeter between the inner and outer faces of a respective one of the first and second portions when the flexible bladder is in the expanded condition.

Thus, in the collapsed condition of the bladder prior to inflation or expansion by the foaming components, the second portion is insertable through the breach or hole, and the introduction of the foaming materials into the interior space extends the bladder into a structure in which the first and second portions are positioned on either side of the breached wall structure, with the linking portion holding the first and second portions in close proximity to the wall structure.

In another optional embodiment (see FIG. 11) that is especially suitable for closing breaches or holes in tubular pipe walls, the flexible bladder comprises a band structure 72 for extending about a section of the pipe around the hole. The band structure 72 has first 73 and second 74 ends that are connectable together to form an annular band for encircling the section of pipe. The mixing tube 67 may extend from near the first end 73 of the band structure to near the second end 74 of the band structure. The band structure 72 may include connecting means for connecting the first 73 and second 74 ends of the band structure together once the structure has been wrapped about the pipe, and should be strong enough to hold the ends together while the flexible bladder expends from the collapsed condition to the expanded condition. In one embodiment of the invention, the connecting means comprises securing clasps 75 that mounted on the outer wall 66 of the flexible bladder.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

I claim:

1. A breach filling apparatus for plugging a hole in a structure, said breach filling apparatus comprising:

an air supply assembly for supplying pressurized air;

a converting assembly for converting air pressure to lineal movement, the converting assembly being connected to the air supply assembly;

a component storage assembly for storing fluid components of a foaming material therein and expelling the components upon lineal movement by the converting assembly, the component storage assembly having an outlet for outputting the components stored in the component storage assembly;

an outlet conduit in fluid communication with the outlet of the component storage assembly for receiving the components outputted from the component storage assembly;

a plugging assembly for plugging a hole through a wall structure, the plugging assembly comprising:

an inflatable flexible bladder having an interior space for receiving the fluid components and expanding in size from a collapsed condition to an expanded condition, the flexible bladder having an outer wall defining the interior space; and a mixing tube in fluid communication with the outlet conduit and extending into the interior space of the flexible bladder for expelling the components into the interior space of the flexible bladder, the mixing tube having a plurality of apertures therein for dispensing the components from the mixing tube into the interior space of the flexible bladder;

wherein the flexible bladder has a first portion, a second portion and a linking portion extending between and linking the first and second portions, the first and second portions generally having a disc shape with substantially planar inner and outer faces when the flexible bladder is in the expanded condition, the linking portion extending between the inner faces of the first and second portions.

2. The apparatus of claim 1 wherein the mixing tube extends through the interior space of the first portion and the linking portions and into the interior space of the second portion.

3. The apparatus of claim 1 wherein each of the first and second portions has a substantially circular perimeter between the inner and outer faces of a respective one of the first and second portions when the flexible bladder is in the expanded condition.

4. A breach filling apparatus for plugging a hole in a structure, said breach filling apparatus comprising:

an air supply assembly for supplying pressurized air;

a converting assembly for converting air pressure to lineal movement, the converting assembly being connected to the air supply assembly;

a component storage assembly for storing fluid components of a foaming material therein and expelling the components upon lineal movement by the converting assembly, the component storage assembly having an outlet for outputting the components stored in the component storage assembly;

an outlet conduit in fluid communication with the outlet of the component storage assembly for receiving the components outputted from the component storage assembly;

a plugging assembly for plugging a hole through a wall structure, the plugging assembly comprising:

an inflatable flexible bladder having an interior space for receiving the fluid components and expanding in size from a collapsed condition to an expanded condition, the flexible bladder having an outer wall defining the interior space; and a mixing tube in fluid communication with the outlet conduit and extending into the interior space of the flexible bladder for expelling the components into the interior space of the flexible bladder, the mixing tube having a plurality of apertures therein for dispensing the components from the mixing tube into the interior space of the flexible bladder;

wherein the flexible bladder comprises a band structure for positioning about a section of a pipe.

5. The apparatus of claim 4 wherein the band structure has first and second ends connectable together to form an annular band.

6. The apparatus of claim 5 wherein the flexible bladder has connecting means for connecting the first and second ends of the bladder structure together.

7. The apparatus of claim 1 wherein the air supply assembly comprises:

a tank for holding pressurized air, the tank having an outlet;

an air conduit in fluid communication with the outlet of the tank; and a valve in fluid communication with the air conduit for controlling air flow through the air conduit.

8. The apparatus of claim 1 wherein the converting assembly comprising:

a housing having an interior; and a piston movably mounted in the interior of the housing on a shaft such that air moving into the interior of the housing pushes the piston and the shaft from a first position toward a second position in the interior.

9. The apparatus of claim 1 wherein the component storage assembly comprises:

a storage housing defining a first chamber for holding a first component and a second chamber for holding a second component, each of the chambers having a chamber outlet, the chamber outlet of the first chamber being in communication with a first conduit and the chamber outlet of the second chamber being in communication with a second conduit;

a first piston slidably mounted in the first chamber;

a second piston mounted in the second chamber.

10. The apparatus of claim 9 additionally comprising a plunger assembly operatively connected to the converting assembly and to the first and second pistons for moving the pistons in the chambers when the converting assembly converts air pressure to lineal movement.

11. A breach filling apparatus for plugging a hole in a structure, said breach filling apparatus comprising:

an air supply assembly for supplying pressurized air;

a converting assembly for converting air pressure to lineal movement, the converting assembly being connected to the air supply assembly;

a component storage assembly for storing fluid components of a foaming material therein and expelling the components upon lineal movement by the converting assembly the component storage assembly having an outlet for outputting the components stored in the component storage assembly;

an outlet conduit in fluid communication with the outlet of the component storage assembly for receiving the components outputted from the component storage assembly;

a plugging assembly for plugging a hole through a wall structure, the plugging assembly comprising:

an inflatable flexible bladder having an interior space for receiving the fluid components and expanding in size from a collapsed condition to an expanded condition, the flexible bladder having an outer wall defining the interior space; and a mixing tube in fluid communication with the outlet conduit and extending into the interior space of the flexible bladder for expelling the components into the interior space of the flexible bladder, the mixing tube having a plurality of apertures therein for dispensing the components from the mixing tube into the interior space of the flexible bladder;

wherein the component storage assembly comprises:

a storage housing defining a first chamber for holding a first component and a second chamber for holding a second component, each of the chambers having a chamber outlet, the chamber outlet of the first chamber being in communication with a first conduit and the chamber outlet of the second chamber being in communication with a second conduit;

a first piston slidably mounted in the first chamber;

a second piston mounted in the second chamber;

a plunger assembly operatively connected to the converting assembly and to the first and second pistons for moving the pistons in the chambers when the converting assembly converts air pressure to lineal movement;

wherein the plunger assembly comprises:

a first rod mounted on the first piston and extending out of the first chamber;

a second rod mounted on the second piston and extending out of the second chamber;

a connecting member connecting the first and second rods together for moving the first and second rods and the first and second pistons together, the connecting member being connected to the converting assembly.

12. The apparatus of claim 1 wherein the outlet conduit has a quick release connector mounted thereon for releasably connecting the outlet conduit to the outlet of the component storage assembly.

13. A breach filling apparatus for plugging a hole in a structure, said breach filling apparatus comprising:

an air supply assembly for supplying pressurized air, the air supply assembly comprising:

a tank for holding pressurized air, the tank having an outlet;

an air conduit in fluid communication with the outlet of the tank;

a valve in fluid communication with the air conduit for controlling air flow through the air conduit;

a converting assembly for converting air pressure to lineal movement, the converting assembly being connected to the air supply assembly, the converting assembly comprising:

a housing having an interior, the interior being in communication with the outlet of the air tank;

a piston movably mounted in the interior of the housing on a shaft such that air moving into the interior of the housing pushes the piston and the shaft from a first position toward a second position in the interior;

a component storage assembly for storing fluid components of a foaming material therein and expelling the components upon lineal movement by the converting assembly, the component storage assembly having an outlet for outputting the components stored in the component storage assembly, the component storage assembly comprising:

a storage housing defining a first chamber for holding a first component and a second chamber for holding a second component, each of the chambers having a chamber outlet, the chamber outlet of the first chamber being in communication with a first conduit and the chamber outlet of the second chamber being in communication with a second conduit;

a first piston slidably mounted in the first chamber;

a second piston mounted in the second chamber;

a plunger assembly operatively connected to the shaft of the piston of the converting assembly and to the first and second pistons for moving the pistons in the chambers when the converting assembly converts air pressure to lineal movement, the plunger assembly comprising:

a first rod mounted on the first piston and extending out of the first chamber;

a second rod mounted on the second piston and extending out of the second chamber;

a connecting member connecting the first and second rods together for moving the first and second rods and the first and second pistons together, the connecting member being connected to the shaft of the converting assembly;

an outlet conduit in fluid communication with the outlet of the component storage assembly for receiving the components outputted from the component storage assembly, the outlet conduit having a quick release connector mounted thereon for releasably connecting to the outlet of the component storage assembly;

a plugging assembly for plugging a hole through a wall structure, the plugging assembly comprising:

an inflatable flexible bladder having an interior space for receiving the fluid components and expanding in size from a collapsed condition to an expanded condition, the flexible bladder having an outer wall defining the interior space;

a mixing tube in fluid communication with the outlet conduit and extending into the interior space of the flexible bladder for expelling the components into the interior space of the flexible bladder, the mixing tube having a plurality of apertures therein for dispensing the components from the mixing tube into the interior space of the flexible bladder.

14. The apparatus of claim 13 wherein the flexible bladder has a first portion, a second portion and a linking portion extending between and linking the first and second portions, the first and second portions generally having a disc shape with substantially planar inner and outer faces when the flexible bladder is in the expanded condition, the linking portion extending between the inner faces of the first and second portions, the mixing tube extending through the interior space of the first portion and the linking portions and into the interior space of the second portion, each of the first and second portions having a substantially circular perimeter between the inner and outer faces of a respective one of the first and second portions when the flexible bladder is in the expanded condition.

15. The apparatus of claim 13 wherein the flexible bladder comprises a band structure for positioning about a section of a pipe, the band structure having first and second ends connectable together to form an annular band, the mixing tube extending from near the first end of the band structure to near the second end of the band structure, the flexible bladder having connecting means for connecting the first and second ends of the bladder structure together.

* * * * *